United States Patent [19]

Elmalek et al.

[11] Patent Number: 5,038,429

[45] Date of Patent: Aug. 13, 1991

[54] UNDERMATTRESS AND METHOD OF MANUFACTURING THE UNDERMATTRESS

[75] Inventors: Pierre Elmalek, Paris; Guy Nathan, Vanves, both of France

[73] Assignee: Vieux Chene Expansion Sarl, Montmagny, France

[21] Appl. No.: 459,386

[22] Filed: Jan. 5, 1990

[30] Foreign Application Priority Data

Jan. 9, 1989 [FR] France ..... 89 00146

[51] Int. Cl.[5] ..... A47C 31/12; A47C 23/06

[52] U.S. Cl. ..... 5/236.1; 5/238

[58] Field of Search ..... 5/236.1, 237, 238, 191

[56] References Cited

U.S. PATENT DOCUMENTS 4,525,886 7/1985 Savenije ..... 5/236.1

FOREIGN PATENT DOCUMENTS 0038155 10/1981 European Pat. Off. .
0085468 8/1983 European Pat. Off. .
2621803 6/1977 Fed. Rep. of Germany .
3232123 3/1984 Fed. Rep. of Germany .
491630 6/1970 Switzerland .

*Primary Examiner*—Alexander Grosz
*Attorney, Agent, or Firm*—Nixon & Vanderhye

[57] ABSTRACT

The present invention discloses a fluid suspension undermattress and the method of manufacturing such an undermattress. The undermattress comprises a set of slats whose ends are mounted fixedly or removably for bearing on fluid suspension means.

14 Claims, 3 Drawing Sheets

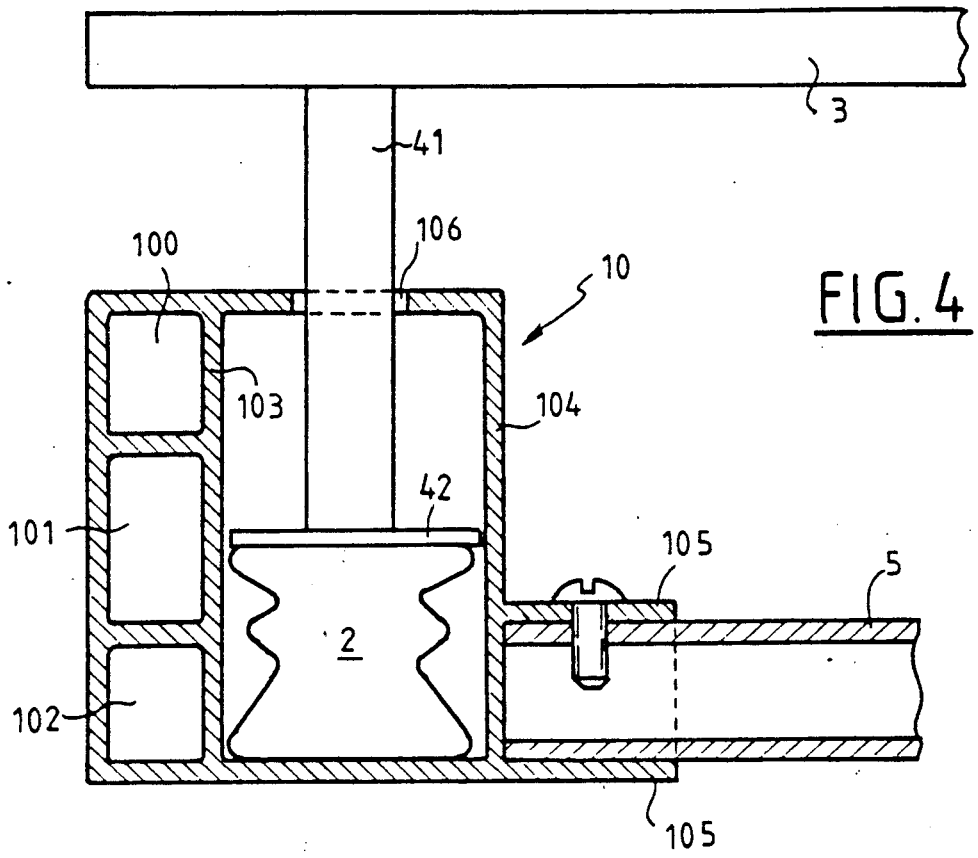
FIG. 4
FIG. 5
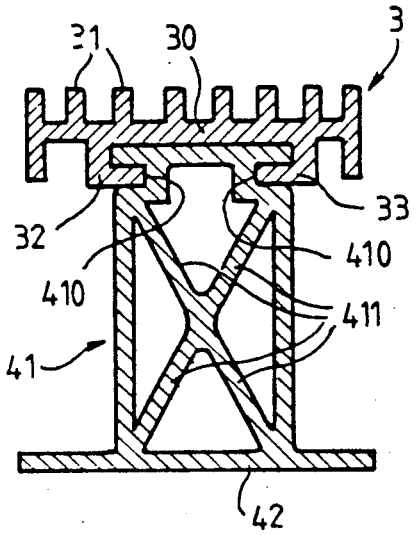
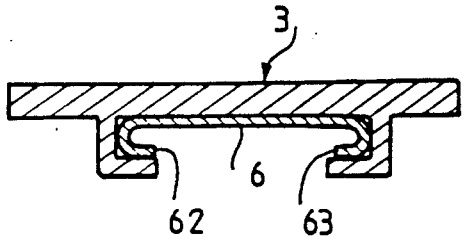

UNDERMATTRESS AND METHOD OF MANUFACTURING THE UNDERMATTRESS

The present invention relates to an undermattress, in particular with a fluid suspension element and the method of manufacturing such an undermattress.

BACKGROUND OF THE INVENTION

Water beds are known whose principle consists in placing on a rigid undermattress, generally formed by a frame whose bottom is closed by a wooden plank, a water mattress formed of a sealed material envelope filled with water. This type of bed has the drawback of requiring a sufficient thickness of water so that the user does not rest directly on the wooden support. Because of this thickness, this type of bed has considerable weight and high thermal inertia.

To overcome this latter drawback, a system is sometimes added for heating the water so that the user does not have the unpleasant feeling of a cold contact. On the other hand, this bed has the advantage of uniformly distributing the pressure of the water over the whole body. These beds are used for this advantage, particularly in medicine.

Because of the direct contact of the sealed envelope with the body of the user, problems arise due to condensation and the lack of aeration for the part of the body of the user in contact with the sealed envelope.

SUMMARY OF THE INVENTION

A first aim of the invention is to provide an undermattress making possible the uniform distribution of the pressures exerted by the undermattress on the body of the user while reducing the weight of the bed and improving the feeling of comfort (thermal and other).

This first aim is attained by the fact that the undermattress comprises an assembly of slats whose ends are mounted, fixedly or removably, bearing on fluid suspension means.

According to another characteristic, the fluid suspension means are formed on each longitudinal side of the frame of the undermattress by at least one flexible reservoir partially filled with a fluid, each reservoir being supported along a longitudinal side of the frame of the undermattress.

According to another characteristic, each longitudinal side of the undermattress comprises indentations in line with the position of each slat.

According to another characteristic, each longitudinal reservoir is divided into compartments and the compartments communicate with each other through a fluid flow orifice forming a constriction for reducing oscillation phenomena.

According to another characteristic, the compartments are formed by membranes disposed transversely to the axis of symmetry of the reservoir.

Another aim of the invention is to provide a first method of constructing the fluid suspension mattress in which the slats are fixed to the envelope of the reservoir.

This aim is attained by the fact that the reservoir comprises strips fixed to the envelope of the reservoir by bonding or welding, these strips allowing slats to be removably fitted.

According to another characteristic, the trough receiving the reservoir is formed of a sheet metal U screwed on to the longitudinal member of the frame.

Another aim of the invention is to provide a second method of construction in which the slats bear on the fluid suspension.

This aim is attained by the fact that each slat comprises at each of its ends an element whose section is in the form of a U having a width between the legs of the U for fitting the trough.

Another aim of the invention is to provide a method of constructing the latter for readily obtaining the parts by molding and thus form an undermattress whose cost of manufacture is not high.

This aim is attained by the fact that each longitudinal side of the frame of the undermattress is formed of a molded material tube inside which the flexible reservoir is placed, said tube being provided with openings for passing therethrough the support piston.

According to another characteristic, one of the longitudinal walls of the tube has reinforcement means.

In this embodiment, the piston is formed by a flat face of a pusher element of rectangular cross section comprising at the end, opposite the flat face, a head for fixing the slat elements.

In this embodiment, the slat elements comprise on their upper face reinforcement grooves and on the lower face studs for snap-fitting on to the fixing head of the piston.

In this embodiment, a resilient blade with bent down edges for snap-fitting on to the piston head is placed under the plastic slat element for reinforcing this latter.

A last aim of the invention is to provide a method of manufacturing such a fluid suspension undermattress.

This aim is attained by the fact that the method consists:

in manufacturing a bed frame having on each longitudinal side means for receiving a fluid reservoir and means permitting the vertical movement of the slats;

in manufacturing two independent fluid reservoirs;

in placing the slats on each of the fluid reservoirs disposed on each side in the means receiving these reservoirs, the slats being disposed in the positions corresponding to the means permitting their vertical movement.

BRIEF DESCRIPTION OF THE DRAWINGS

Other features and advantages of the present invention will be clear from reading the following description made with reference to the accompanying drawings in which:

FIG. 4 is a cross sectional view of another embodiment of the invention; and FIG. 5 is a side view of a piston element of the second embodiment associated with a slat element.

DESCRIPTION OF THE EMBODIMENT

Figure 1:
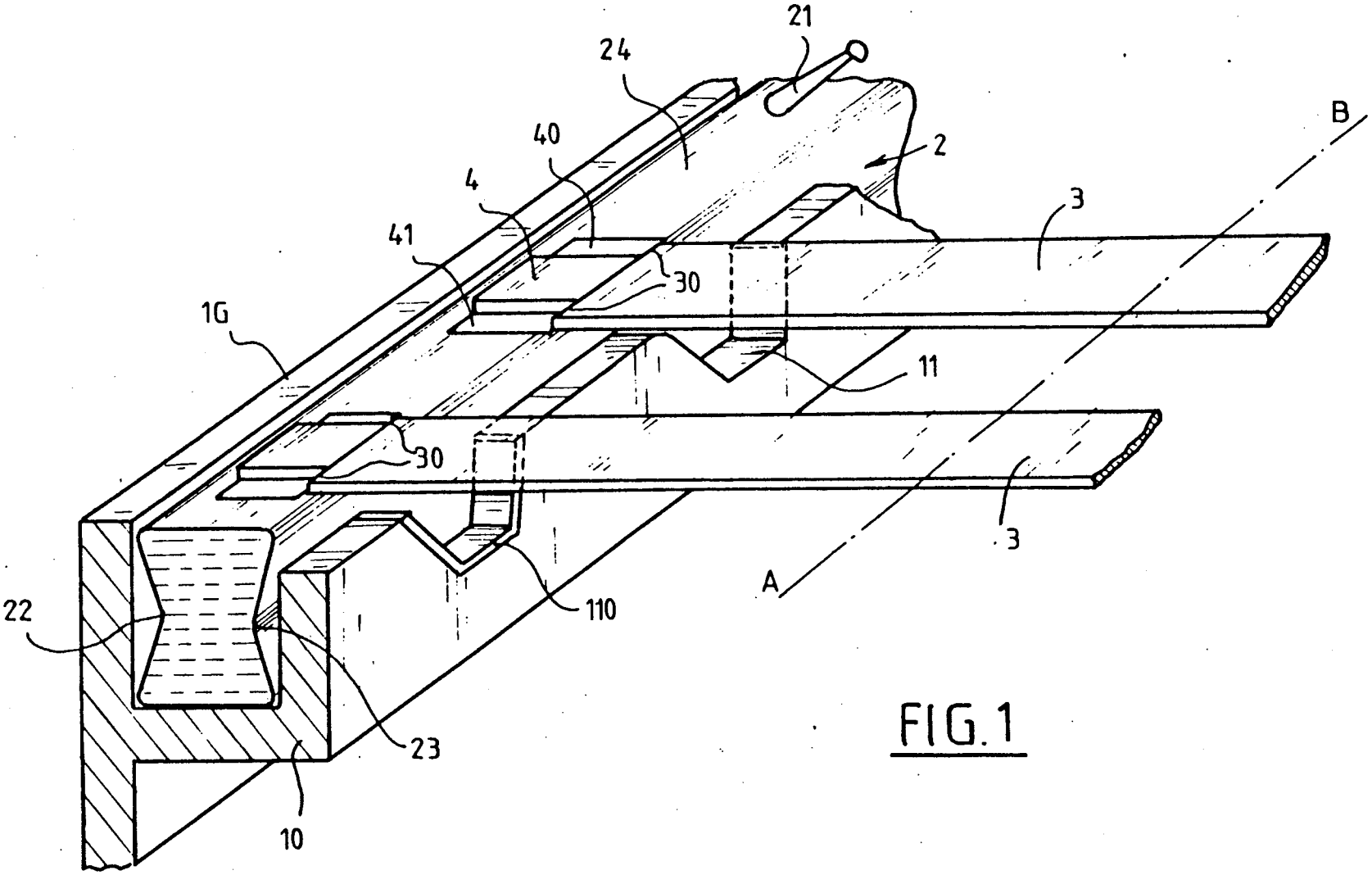
FIG. 1 is a partial perspective view of a section of one longitudinal side of the frame forming the framework of the slatted undermattress according to the invention.

The undermattress comprises a frame (e.g. made from wood) formed of two side members or longitudinal sides 1G, 1D only one of which, side member 1G corresponding to the left-hand side of the frame, is shown in FIG. 1. Each end of these side members is secured to transverse members 4, 5 forming the head and respectively the foot of the frame of the undermattress. On side member 1G is fixed a longitudinal piece 10 having a section in the form of a right-angled piece so as to form with the side member a trough having a substantially U shaped cross section. In a variant of the side member, the side member-longitudinal piece 10 assembly may be made in a single piece. Another solution may also be to use a U shaped trough made from sheet metal and screwed by one of its sides on to side member 1G. In the trough of the left-hand side member of the frame is placed a reservoir 2 formed of a longitudinal cylinder closed at both ends. This cylinder is made from a flexible material such as polyester cloth and may comprise two longitudinal folds 22, 23 facilitating folding and storage of the reservoir. Each reservoir comprises a filling pipe 21 closed by a plug. Symmetrically with respect to the axis of symmetry AB of FIG. 1, there is provided a second right-hand side member 1D forming a U shaped trough and a second longitudinal reservoir on which bear the second ends of slats 3. Each end of a slat 3 may be fixed to the upper face 24 of the reservoir by any appropriate means. Such fixing may be provided by strips 4 whose lateral tongues 40, 41 are bonded or welded to the upper face 24. These strips 4 may be made from the same flexible material as the reservoir or from any other material permitting assembly with this latter. The material of the reservoir may be formed advantageously by a polyester fabric or any other flexible, sealed and non elastic material. Advantageously, the width of strip 4 between tongues 40, 41 is less than the width of the central portion of the slat 3. Thus, slat 3 bears by shoulders 30 against the sleeve formed by strip 4, tongues 40, 41 and the upper surface 24 of the reservoir. The ends of slats 3 obviously have a portion of reduced width corresponding to the width of strip 4. The sleeve thus formed on the surface 24 of the reservoir may be open at its ends or open simply at the end facing the inside of the frame of the undermattress. The right-angled piece 10 comprises notches 11 opposite the positions where the slats and the strips for fixing the slats on the reservoirs are located. These notches 11 are provided on the vertical portion of the right-angled piece 10 and may, in a variant, be provided with a rubber or plastic lining 110 playing the role of damper element and protecting against wear. These linings facilitate the sliding of slat 3 against the lateral edges of the indentation while reducing the wear which the slat will thus undergo. At the same time, these linings reduce the rubbing and shock noises when slat 3 bears against the bottom of the indentation or on the sides of the indentation. A bed is formed by fitting the end of each slat into corresponding housings placed on both reservoirs, then positioning the assembly of slats 3 and the two reservoirs 2 mounted at their ends in two troughs provided on each side of the longitudinal axis of symmetry of the bed. The bed may thus be delivered and the customer may then fill the two lateral reservoirs of the bed through the filling orifices 21. With the reservoirs partially filled, when the user lies on the undermattress provided with a mattress, the different portions of his body will cause greater or lesser movements of the slats. These movements of the slats will generate a displacement of the fluid mass so as to balance the pressures inside each reservoir. Thus, the pressure inside the left-hand reservoir will be identical everywhere and similarly that inside the right-hand reservoir will be identical. This holds the body in position with a pressure also distributed at the position of the slats. It will then be readily understood that an undermattress is thus formed which has the advantages of water beds without having the drawback of the weight thereof. Furthermore, such an undermattress, because of the presence of slats, provides better aeration of the mattress and so of the body and also overcomes the thermal problems related to water mattresses.

Figure 2:
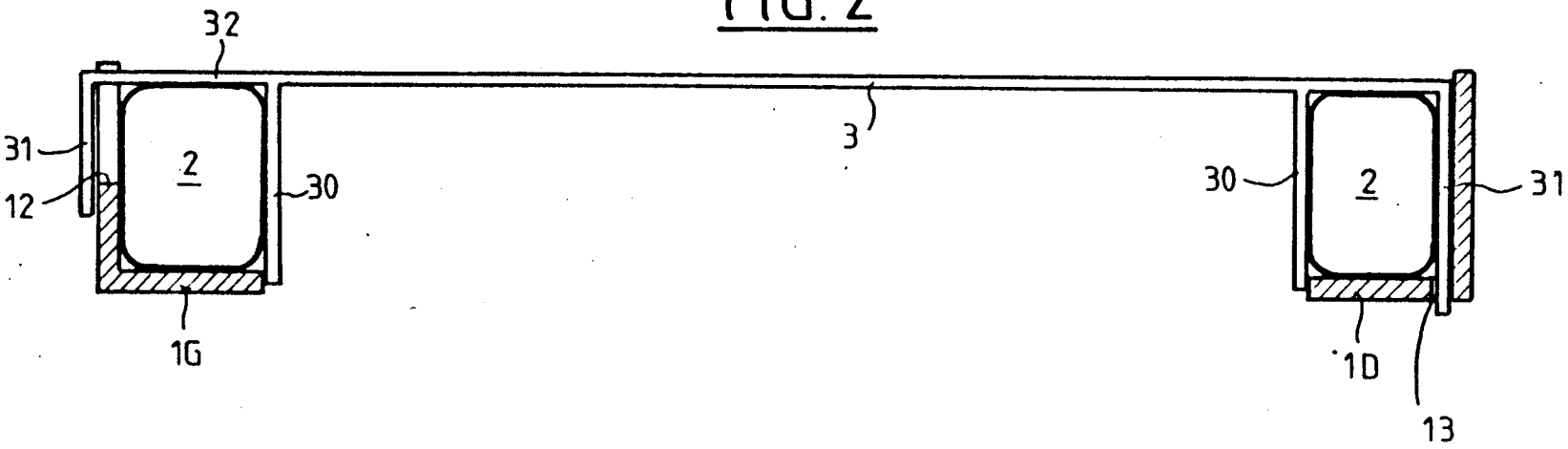
FIG. 2 shows a front view in cross section of an undermattress.

FIG. 2 shows two other possible constructional variants. In this FIG. 2, the left-hand side member 1G and the right-hand side member 1D have been shown, both formed by a longitudinal piece with right-angled cross section. The constructional variant associated with the left-hand side member is formed of a slat 3 whose end comprises a U shaped element formed by a central portion 32 and two side legs 31, 30 spaced apart by a distance for fitting the reservoir formed by the side member 1G. Side member 1G has, spaced evenly apart by a distance corresponding to the distance between two slats, notches 12 in the vertical leg of the right-angle. The reservoir 2 rests in the right-angled trough 1G. In this embodiment, leg 30 holds the flexible reservoir in position during movement of the slat 3. Notches 12 guide the slats in their movement. In this variant, the side member G might have a U shaped section with notches disposed at the position of the tongues 30 of the slats for sliding thereof.

The right-hand portion of FIG. 2, associated with a right-hand side member 1D shows another embodiment in which the U shaped end of the slat comprises two legs 30, 31 spaced apart by a distance corresponding to the dimension of the horizontal leg of the right-angled piece 1D. The right-angled piece 1D has openings or notches 13 spaced evenly apart which permit the passage of the legs 31 of each of the ends of the slats. In this variant, legs 30, 31 hold in position the reservoir 2 associated with the right-hand longitudinal member 1D of the bed.

In another variant corresponding to the left-hand portion of FIG. 2 leg 31 may if required be omitted. In this case, slat 3 which is simply laid in position is guided in notch 12 for its vertical movements and the transverse movements are prevented by tongue 30 which comes to bear on the end of the horizontal leg of the right-angled piece 1G.

It is obvious that for each variant shown respectively on the left-hand member and the right-hand member, the associated opposite member, respectively right-hand and left-hand will have the same type of construction. Similarly, in each of the variants of FIG. 2, slats 3 rest simply by their ends on reservoirs 2.

Figure 3:
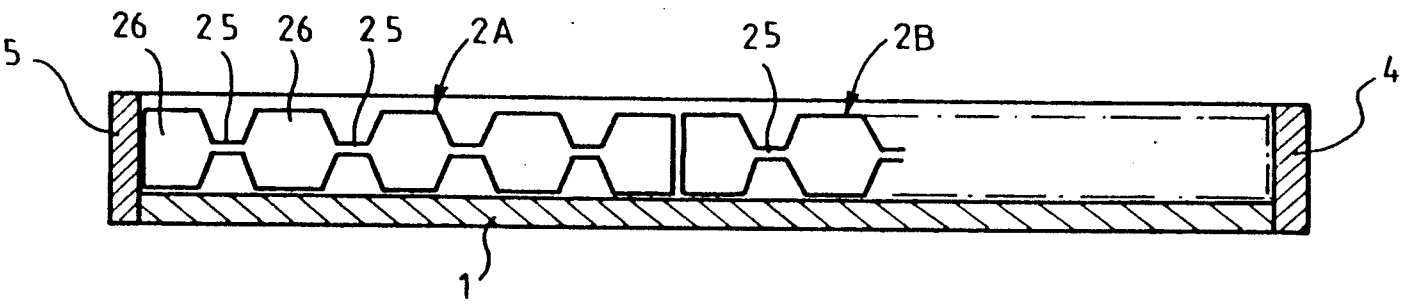
FIG. 3 is a sectional view through the longitudinal axis of symmetry of a reservoir according to a construction a variant.

FIG. 3 shows a preferred variant of construction of the reservoir of the undermattress in which a longitudinal member 1 is shown in longitudinal section and has at its ends the transverse members 4 and 5 also shown in section and forming respectively the head and the foot of the bed. In this variant, the reservoir associated with a longitudinal member may be formed of two or more elements. Thus, in FIG. 3, two elements 2A, 2B have been shown forming two independent reservoirs associated with a longitudinal member. In this case, the opposite longitudinal member also comprises two independent reservoirs. As shown in this figure, each reservoir 2A,2B may be formed of a set of compartments serially connected together by constrictions 25 for slowing down the flow of fluid from one compartment to another in order to limit the oscillation and fluctuation effects due to the sudden movements of the user. Furthermore, the use of several reservoirs along a longitudinal member makes it possible, by filling each of the reservoirs differently, to vary the pressure between two or several zones of the body of the user.

FIG. 4 shows a cross sectional view of a preferred embodiment of a tubular longitudinal element 10 formed of a tube of rectangular cross section and whose length corresponds to the length of the longitudinal sides of the undermattress.

Along the external longitudinal face of this tubular element 10 are provided reinforcement means, obtained in the same manufacturing procedure and formed of hollow tubular elements 100, 101, 102 fast with the external longitudinal face 103 of the tube 10. These tubular elements 100, 101, 103 in this embodiment form the longitudinal member of the frame of the undermattress.

The internal longitudinal face 104 of tube 10 comprises fixing means 105 which make it possible for cross pieces 5 to form the cross members of the frame of the undermattress. Tube 10 comprises on its upper face, turned towards the slats of the undermattress, orifices 106 of appropriate shape for passing therethrough a piston 41 to one end of which is fixed the slat 3 and the other end of which has a bearing surface 42 which bears on reservoir 2 containing the suspension fluid.

One preferred embodiment of the piston and slat is shown in FIG. 5. Piston 41 is formed by a tubular element of rectangular section and of a length corresponding to the dimension of orifice 106. The sidewalls of the piston 41 are reinforced by diagonal cross pieces 411. At the end opposite the one fixed to the bearing face 42 of the piston on the reservoir 2, grooves 410 are formed so as to form a fixing head for the slat element 3. The slat element 3 is formed by a central blade 30 whose upper face is reinforced by grooves 31 and the lower face comprises studs 32, 33 which snap-fit into the grooves 410 of the piston head.

Advantageously, the resilient blade 6 may be disposed inside studs 32, 33 whose bent down edges 62, 63 snap-fit into groove 410. These bent down edges 62, 63 also contribute to improving the rigidity and bending strength of the resilient blade 6 which thus contributes to the rigidity of the slat by being fixed at each of its ends to the piston heads disposed on each side on the left-hand side member and on the right-hand side member of the undermattress.

The elements shown in FIGS. 4 and 5 have shapes specially adapted for permitting manufacture by molding or extrusion from a plastic material such for example as PVC. Thus, this embodiment makes it possible to inexpensively construct a bed operating in accordance with the principle of the invention and used with reservoirs provided or not with constrictions for reducing oscillation.

Other modifications within the scope of a man skilled in the art also form part of the spirit of the invention.

What is claimed is:

1. An undermattress comprising:

a frame having opposite longitudinally extending sides;

a plurality of slats;

fluid suspension means for mounting the ends of the slats on said frame;

said fluid suspension means being provided on each said longitudinal side of the frame of the undermattress and including means defining at least one flexible reservoir at least partially filled with a fluid, said reservoir being supported along said longitudinal side of the frame of the undermattress;

each longitudinal side of the frame of the undermattress being formed of a molded or extruded tube, said flexible reservoir being received within said tube, a pair of pistons along each longitudinal side of said frame, said tube having openings for receiving support rods for said pistons, each said piston at one end of said piston rod having a flat face comprising a pusher element of rectangular section, said piston rod having at its opposite end a head for connection with said slats;

each said reservoir being divided into discrete compartments; and means providing fluid communication between said compartments including a fluid flow orifice forming a fluid flow constriction for reducing oscillation phenomena;

the pusher elements of said pair of pistons on each said longitudinal side of said frame bearing on discrete compartments therealong.

2. The undermattress as claimed in claim 1, wherein each slat comprises at each of its ends an element whose section is in the form of an inverted U having a width between its legs for straddling said reservoir.

3. The undermattress as claimed in claim 1, wherein the flow orifices are placed in membranes disposed transversely to the axis of symmetry of the reservoir.

4. The undermattress as claimed in claim 1, wherein one of the longitudinal walls of the tube comprises reinforcement means.

5. The undermattress as claimed in claim 1, wherein the longitudinal sides, the pistons, and said slats are formed from a plastic material.

6. The undermattress as claimed in claim 5, wherein said slats comprise on their upper face reinforcement grooves and on the lower face studs for snap-fitting onto said head.

7. The undermattress as claimed in claim 6, including a resilient blade with bent edges for snap-fitting on said head and under said plastic slat for reinforcing the latter.

8. The undermattress as claimed in claim 1 wherein each of said pistons is formed of a tubular element of rectilinear cross-section having side walls reinforced by cross-pieces extending diagonally between said side walls.

9. An undermattress comprising:

a frame having opposite longitudinally extending sides;

a plurality of slats;

fluid suspension means for mounting the ends of the slats on said frame;

said fluid suspension means being provided on each said longitudinal side of the frame of the undermattress and including means defining at least one flexible reservoir at least partially filled with a fluid, said reservoir being supported along said longitudinal side of the frame of the undermattress;

each longitudinal side of the frame of the undermattress being formed of a molded or extruded tube, said flexible reservoir being received within said tube, a pair of pistons along each longitudinal side of said frame, said tube having openings for receiving support rods for said pistons, each said piston at one end of said piston rod having a flat face comprising a pusher element of rectangular section, said piston rod having at its opposite end a head for connection with said slats;

each said reservoir being divided into discrete compartments; and means providing fluid communication between said compartments including a fluid flow orifice forming a fluid flow constriction for reducing oscillation phenomena;

each of said pistons being formed of a tubular element of rectilinear cross-section having side walls reinforced by cross-pieces extending diagonally between said side walls.

10. The undermattress as claimed in claim 9 wherein the flow orifices are placed in membranes disposed transversely to the axis of symmetry of the reservoir.

11. The undermattress as claimed in claim 9 wherein one of the longitudinal walls of the tube comprises reinforcement means.

12. The undermattress as claimed in claim 9 wherein the longitudinal sides, the pistons, and said slats are formed from a plastic material.

13. The undermattress as claimed in claim 12 wherein said slats comprise on their upper face reinforcement grooves and on the lower face studs for snap-fitting onto said head.

14. The undermattress as claimed in claim 13 including a resilient blade with bent edges for snap-fitting on said head and under said plastic slat for reinforcing the latter.

* * * * *